US009435007B2

(12) United States Patent
Han et al.

(10) Patent No.: US 9,435,007 B2
(45) Date of Patent: Sep. 6, 2016

(54) TITANIUM METAL PRODUCTION APPARATUS AND PRODUCTION METHOD FOR TITANIUM METAL

(75) Inventors: Gang Han, Yasugi (JP); Tatsuya Shoji, Yasugi (JP); Shujiroh Uesaka, Yasugi (JP); Mariko Fukumaru, Yasugi (JP); Maher I. Boulos, Sherbrooke (CA); Jiayin Guo, Sherbrooke (CA); Jerzy Jurewicz, Sherbrooke (CA)

(73) Assignees: HITACHI METALS, LTD., Tokyo (JP); TEKNA PLASMA SYSTEMS INC., Sherbrooke (CA)

( * ) Notice: Subject to any disclaimer, the term of this patent is extended or adjusted under 35 U.S.C. 154(b) by 596 days.

(21) Appl. No.: 13/988,625

(22) PCT Filed: Nov. 16, 2011

(86) PCT No.: PCT/JP2011/076422
§ 371 (c)(1),
(2), (4) Date: Jun. 7, 2013

(87) PCT Pub. No.: WO2012/070452

PCT Pub. Date: May 31, 2012

(65) Prior Publication Data

US 2013/0255443 A1 Oct. 3, 2013

(30) Foreign Application Priority Data

Nov. 22, 2010 (JP) ..... 2010-260109

(51) Int. Cl.

| | |
|---|---|
| ***C22B 34/12*** | (2006.01) |
| ***B22F 9/28*** | (2006.01) |
| ***B22F 9/26*** | (2006.01) |
| ***F27D 99/00*** | (2010.01) |

(52) U.S. Cl.
CPC ..... *C22B 34/129* (2013.01); *B22F 9/26* (2013.01); *C22B 34/1272* (2013.01); *F27D 99/00* (2013.01)

(58) Field of Classification Search
None
See application file for complete search history.

(56) References Cited

U.S. PATENT DOCUMENTS

| | | | | |
|---|---|---|---|---|
| 2,997,385 | A | 8/1961 | Winter, Jr. | |
| 4,877,445 | A * | 10/1989 | Okudaira | C01B 33/033 423/350 |
| 9,163,299 | B2 * | 10/2015 | Boulos | C22B 34/1272 |
| 2006/0191372 | A1 | 8/2006 | Haidar | |
| 2008/0264208 | A1 | 10/2008 | Jacobsen et al. | |
| 2009/0120239 | A1 | 5/2009 | Jensen et al. | |
| 2009/0260481 | A1 | 10/2009 | Boulos et al. | |
| 2013/0095243 | A1 * | 4/2013 | Han | C22B 34/1272 427/250 |

FOREIGN PATENT DOCUMENTS

| | | | |
|---|---|---|---|
| CN | 1812859 | A | 8/2006 |
| CN | 101014721 | A | 8/2007 |
| CN | 101594953 | A | 12/2009 |
| JP | 33-003004 | B1 | 4/1958 |
| JP | 63-230833 | A | 9/1988 |
| JP | 64-015334 | A | 1/1989 |
| JP | 2009-242946 | A | 10/2009 |
| JP | 2010-516893 | A | 5/2010 |
| JP | 2011-231402 | A | 11/2011 |
| WO | 2010/137688 | A1 | 12/2010 |
| WO | 2011/125402 | A1 | 10/2011 |

* cited by examiner

*Primary Examiner* — George Wyszomierski
(74) *Attorney, Agent, or Firm* — Sughrue Mion, PLLC

(57) ABSTRACT

A titanium metal production apparatus is provided with (a) a first flow channel that supplies magnesium in a state of gas, (b) a second flow channel that supplies titanium tetrachloride in a state of gas, (c) a gas mixing section in which the magnesium and titanium tetrachloride in a state of gas are mixed and the temperature is controlled to be 1600° C. or more, (d) a titanium metal deposition section in which particles for deposition are arranged so as to be movable, the temperature is in the range of 715 to 1500° C., and the absolute pressure is 50 kPa to 500 kPa, and (e) a mixed gas discharge section which is in communication with the titanium metal deposition section.

11 Claims, 2 Drawing Sheets

TITANIUM METAL PRODUCTION APPARATUS AND PRODUCTION METHOD FOR TITANIUM METAL

CROSS REFERENCE TO RELATED APPLICATIONS

This application is a National Stage of International Application No. PCT/JP2011/076422 filed Nov. 16, 2011 (claiming priority based on Japanese patent Application No. 2010-260109, filed Nov. 22, 2010), the contents of which are incorporated herein by reference in their entirety.

TECHNICAL FIELD

The present invention generally relates to a process and an apparatus for producing titanium metal. More specifically, the invention relates to a process and an apparatus for producing titanium metal by allowing titanium metal to be deposited and grown on surfaces of particles for deposition from a mixed gas of titanium tetrachloride and magnesium and collecting the titanium metal.

BACKGROUND ART

Titanium is a light metal having a high mechanical strength to weight ratio and exhibiting superior corrosion resistance. Titanium is widely used in various fields including airplane, medical and automobile industries. A quantity of consumed titanium use has been increasing. Titanium is the fourth most abundant element in the earth's crust after aluminum, iron, and magnesium among metal elements and thus is a plentiful resource. Although titanium is a plentiful resource, titanium is up against short supply and has been at least an order of magnitude more expensive than steel materials.

Titanium metal has been mainly produced by a Kroll Process. In the Kroll Process, titanium ore containing titanium dioxide ($TiO_2$) as a main component is reacted with a chlorine gas and coke (C) to produce titanium tetrachloride ($TiCl_4$). Subsequently, highly-purified titanium tetrachloride is produced through distillation and separation. Titanium metal is produced through thermal reduction of the purified titanium tetrachloride with magnesium (Mg). In the thermal reduction step of the Kroll Process, a reduction reaction vessel made of a stainless steel is filled with a magnesium melt at a temperature of not lower than 800° C. Titanium tetrachloride in a liquid phase is dropped into the vessel from above and reacts with the magnesium melt in the vessel to produce titanium. The produced titanium sinks in the magnesium melt and thus titanium is produced in a sponge form. By-product magnesium chloride and unreacted magnesium in the liquid phase are mixed in the titanium in the sponge form. Upon completion of the reaction, the reaction mixture is subjected to a vacuum separation process at a high temperature of not lower than 1000° C. to obtain a sponge cake of porous titanium. The sponge cake is cut and crushed to produce sponge titanium.

The Kroll Process can effectively produce a titanium material for practical use. However, a long production time is required since the thermal reduction process and the separation process are conducted separately. The production is less efficient since it is a batch process. Accordingly, various techniques have been suggested to overcome the problems of the Kroll Process.

For example, Patent Literature 1 (JP-B1-33-3004) discloses a process including steps of supplying a titanium tetrachloride gas and magnesium vapor in a reaction vessel to cause a gas-phase reaction at a temperature of 800 to 1100° C. and under a vacuumed atmosphere of $10^{-4}$ mmHg ($1.3\times10^{-2}$ Pa) in the vessel, and depositing titanium on a net-like collection material disposed in the vessel to collect titanium.

Patent Literature 2 (U.S. Pat. No. 2,997,385) discloses a process for producing a metal, including steps of introducing halide vapor as a metal element and alkali metal or alkaline earth metal vapor as a reducing agent into a reaction vessel, and causing a gas-phase reaction in the vessel in an evacuated atmosphere under a pressure of 0.01 to 300 mmHg (1.3 Pa to 40 kPa) and at a temperature of 750 to 1200° C. Patent Literature 2 discloses, in Example II, a method for producing titanium from $TiCl_4$ gas and Mg gas, and specifically, the reaction was caused at a reaction temperature of approximately 850° C. and under a pressure of 10 to 200 microns (1.3 to 26.7 Pa).

In Patent Literature 3, titanium particles are supplied in a reaction vessel while titanium tetrachloride gas and magnesium gas are separately injected into the vessel. The titanium particles are floated by the energy of the injection, and a reduction reaction of titanium tetrachloride by magnesium is produced to adhere and accumulate the reduced titanium metal on surfaces of the titanium particles. Patent Literatures 4 and 5 disclose to use a fluidized bed for reducing titanium tetrachloride by magnesium and for depositing so that small titanium particles are produced by the reaction. In Patent Literature 4, produced titanium particles are recycled and further deposited to become larger particles.

CITATION LIST

Patent Literature

Patent Literature 1: JP-B 1-33-3004
Patent Literature 2: U.S. Pat. No. 2,997,385
Patent Literature 3: JP-A-64-15334
Patent Literature 4: JP-A-2010-516893
Patent Literature 5: U.S. Patent Publication No. 2009/0120239
Patent Literature 6: JP-A-2009-242946

SUMMARY OF INVENTION

According to searches by the present inventors, a small amount of titanium can be collected by the process disclosed in Patent Literature 1. However, supply rate of reactants is limited in order to maintain a pressure in a reaction vessel to $10^{-4}$ mmHg. Production capacity may be increased by increasing a size of a vacuum pump and exhaust capability. However, it is difficult to obtain a large amount of titanium metal for industrial use.

By both processes disclosed in Patent Literatures 2 and 3, purified titanium can be collected as well as by the process disclosed in Patent Literature 1. However, a production rate is low at a low pressure.

Particles produced according to the process of Patent Literature 4 are as fine as less than 1 mm, and they can not be efficiently separated from magnesium or $MgCl_2$, and contains many coexisting impurities. The process described in Patent Literature 5 also has a problem of mixing of impurities, and of requiring high purity titanium particles for forming a fluidized bed.

As described above, the literatures suggest processes for producing titanium through a gas-phase reaction of titanium tetrachloride gas and magnesium gas in order to overcome the problems of the Kroll Process. However, it is essentially required to separate by-product $MgCl_2$ or unreacted magnesium in a highly evacuated state according to the processes, and thus it is difficult to obtain a large amount of titanium.

The inventors have proposed a process and an apparatus for depositing titanium metal by supplying titanium tetrachloride and magnesium into RF thermal plasma flame. The titanium tetrachloride and magnesium evaporate in the RF thermal plasma flame and titanium tetrachloride is reduced by magnesium, thereby reduced titanium metal is deposited (JP-A-2009-242946).

According to the process, uniform mixing of titanium tetrachloride gas and magnesium gas is essential for efficient reaction between the gases. Furthermore, in order to increase efficiency of deposition, a deposition substrate having a large surface area is required to ensure a contact area with the mixed gas.

An object of the present invention is to provide a process and an apparatus for producing titanium metal from titanium tetrachloride and magnesium as starting materials by reducing titanium tetrachloride by magnesium and depositing reduced titanium metal on the substrate, and to provide a substrate effective for uniformly mixing titanium tetrachloride gas with magnesium gas and depositing titanium metal produced in the reaction of the mixed gas.

An apparatus for producing titanium metal according to the present invention includes:

(a) a first flow channel for supplying gaseous magnesium;

(b) a second flow channel for supplying gaseous titanium tetrachloride;

(c) a gas mixing section in communication with the first flow channel and the second flow channel, wherein the gaseous magnesium is mixed with the titanium tetrachloride in the gas mixing section, and a temperature in the gas mixing section is controlled at not lower than 1600° C.;

(d) a titanium metal deposition section in communication with the gas mixing section, wherein the titanium metal deposition section is in a temperature range from 715 to 1500° C. and under 50 to 500 kPa in absolute pressure, and wherein particles for deposition are movably disposed in the titanium metal deposition section; and (e) a mixed gas discharge section in communication with the titanium metal deposition section.

The absolute pressure in the titanium metal deposition section is preferably 90 to 200 kPa.

At least one of the first flow channel, the second flow channel, the gas mixing section, and the titanium metal deposition section preferably has a graphite wall. More preferably, a part or entire of the graphite wall can be heated by induction-heating.

A preferable temperature range of the titanium metal deposition section is from 900 to 1400° C.

The particles for deposition are preferably made of titanium or a titanium alloy.

Preferably, the particles for deposition are supplied from an upper portion of the titanium metal deposition section, and the gas mixing section is communicatively connected to a side of the titanium metal deposition section. The titanium metal deposition section may further comprises a gas blower hole for blowing a gas in order to adjust a time for retaining the particles in the titanium metal deposition section. Preferably, the gas blower hole is located in a lower portion of the titanium metal deposition section.

The apparatus may further comprise a particles preheating section for preheating the particles at a temperature from 300 to 1000° C. prior to supply.

A process for producing titanium metal according to the present invention includes steps of:

(a) supplying gaseous magnesium and gaseous titanium tetrachloride in a mixing space at a temperature of not lower than 1600° C. to form a mixed gas;

(b) introducing the mixed gas in a deposition space at a temperature of 715 to 1500° C. and under an absolute pressure of 50 to 500 kPa, wherein particles for deposition are movably disposed in the deposition space;

(c) causing titanium metal deposited and grown on the particles; and (d) discharging the mixed gas after the step (c).

Preferably, the step (b) includes: introducing the mixed gas from a side of the titanium metal deposition section; and supplying the particles from an upper portion of the titanium metal deposition section to allow the particles to fall toward a lower portion. More preferably, the step (b) further includes blowing a gas toward the supplied particles for adjusting retaining time.

Preferably, the step (b) further includes preheating the particles for deposition at a temperature from 300 to 1000° C. prior to supplying the particles.

According to the apparatus and the process for producing titanium metal of the present invention, titanium tetrachloride and magnesium are previously mixed and then subjected to the gas-phase reaction. Thus, titanium can be efficiently produced by the reduction reaction and highly purified titanium can be produced with a high productivity. Since titanium metal is deposited on surfaces of the particles, the number of deposition sites per volume increases, and efficiency of depositing titanium produced in the reduction reaction is increased and thus production efficiency is improved.

The above-described object and other objects, advantages, and features will be apparent from non-restrictive embodiments below with reference to accompanying drawings.

DESCRIPTION OF EMBODIMENTS

Figure 1:
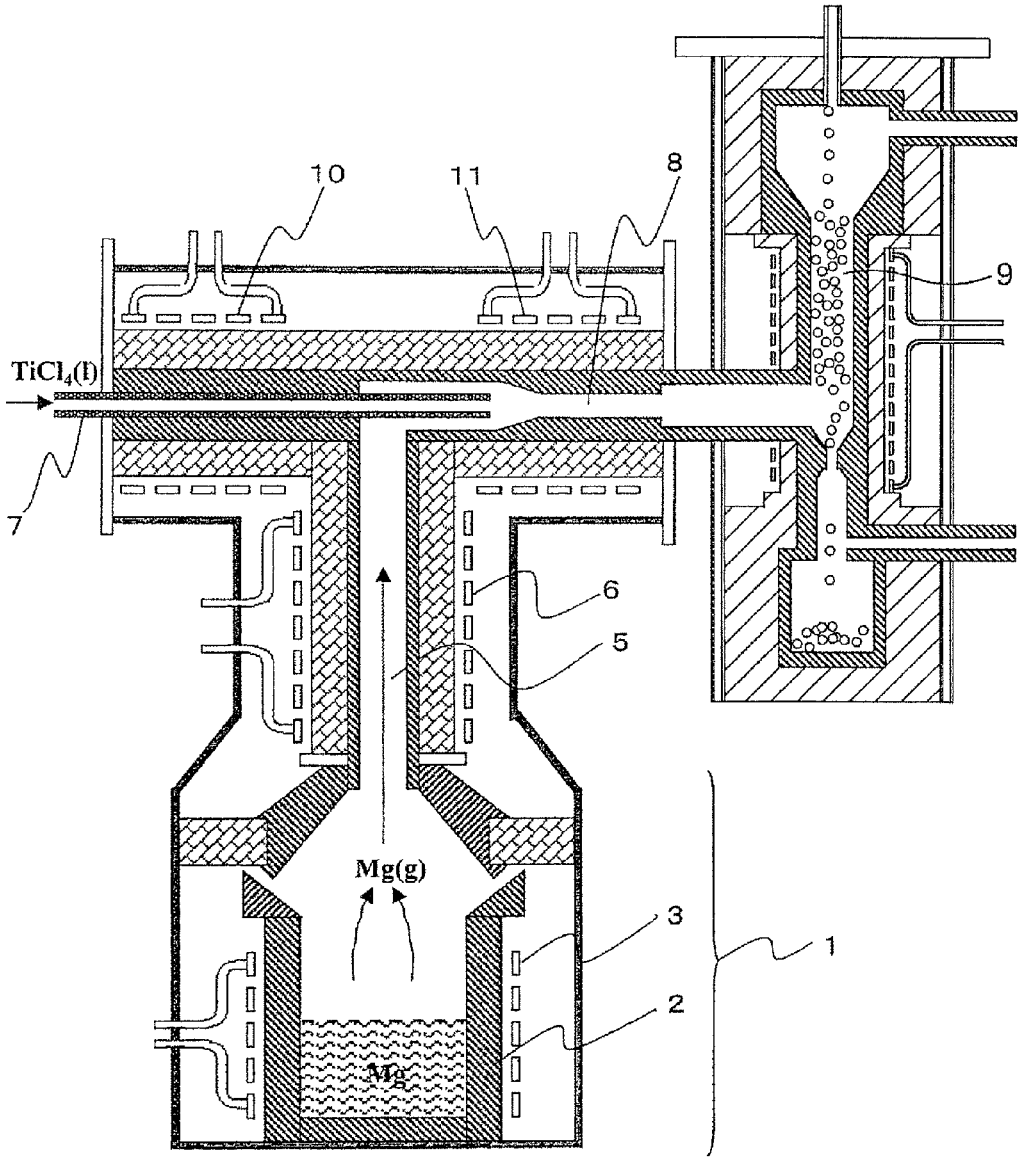
FIG. 1 is a schematic sectional side view of an example apparatus for producing titanium metal.

The invention discloses a novel apparatus and a process for producing titanium metal.

According to the present invention, gaseous magnesium generated by evaporating e.g. solid magnesium, and gaseous titanium tetrachloride are supplied in a mixing space at a temperature of not lower than 1600° C. to form a mixed gas. Since the mixed gas is formed in advance from gaseous titanium tetrachloride gas and gaseous magnesium gas, continuous and uniform reaction can be carried out in a reaction vessel. Since a driving force for producing the reaction between titanium tetrachloride and magnesium decreases depending on increase of temperature, the reaction can be substantially suppressed at the temperature of not lower than 1600° C. and therefore only mixing of the reactant gases can be performed. One important feature of the invention is the formation of a uniform mixed gas of titanium tetrachloride and magnesium.

Next, the mixed gas is introduced into a titanium metal deposition space. The titanium metal deposition space has an absolute pressure of 50 to 500 kPa and is controlled in a temperature range from 715 to 1500° C. A driving force for the reaction of generating titanium is increased as the temperature of the mixed gas decreases. Particles for deposition are movable in the titanium metal deposition space. When the particles in the titanium metal deposition space move, large surfaces thereof promote generation of ununiform nuclei of titanium and production and deposition of titanium.

The absolute pressure of the titanium metal deposition space is 50 to 500 kPa. Lower pressure in the titanium metal precipitation space is advantageous for evaporation separation of magnesium and $MgCl_2$. Even when the reaction occurs un-uniformly, by-products or intermediate compounds can be evaporated and separated since vacuum or depressurization facilitates the evaporation. In fact, the Kroll Process produces titanium by mixing titanium, magnesium, and $MgCl_2$ in a liquid phase and then performing vacuum separation under a pressure of 0.1 to 1 Pa and at a temperature of 1000° C. However, the process of the invention employs the absolute pressure of 50 to 500 kPa that is almost the same as atmospheric pressure. According to the cited literatures, magnesium and $MgCl_2$ can not be separated from titanium under such a pressure. The present inventors have found that titanium is crystallized and grown on the particles even under such a pressure that is not conventionally used, and surprisingly, that the titanium deposition has high purity.

In general, production capability per unit volume of the reactor is increased as a reactor pressure is increased. For example, when a pressure is increased by one order of magnitude, production capability is increased by one order of magnitude. In the invention, the production capability can be remarkably improved since the above pressure is applied, which has not been used hitherto.

Although titanium can be collected in principle even under a pressure of less than 50 kPa, production rate is reduced and possibility of air leakage into an apparatus is increased, as the pressure is reduced. Since titanium has high reactive activity with oxygen and nitrogen, it is required to protect the process from an outer air. As a degree of vacuum is increased, cost for preventing the air leakage in the apparatus during the process is increased. Under a pressure of not lower than 50 kPa, the air leakage can be easily prevented at an industrial production level. Thus, the pressure range of not lower than 50 kPa is preferable for practical use.

Although production capability per unit volume of the reactor is increased as a pressure increases, evaporation efficiency of $MgCl_2$ is reduced. Therefore, as the pressure increases, it becomes difficult to produce highly-purified titanium. In addition, production cost for dealing with the high pressure in an industrial equipment is increased. Thus, the pressure of not greater than 500 kPa is effective.

In view of the production capability, separation efficiency, and economic rationality of industrial equipment, a preferable range of absolute pressure is 90 to 200 kPa.

At a temperature of 715 to 1500° C., titanium can be deposited as particles on the surfaces of the particles for deposition. As the temperature is decreased, although a driving force for generating the reaction is increased, evaporation efficiency of magnesium and $MgCl_2$ is reduced. On the contrary, as the temperature is increased, although $MgCl_2$ and the like are efficiently evaporated, the driving force is reduced. At a temperature higher than 1500° C., reduction reaction of titanium is difficult to proceed. At a temperature less than 715° C., homogeneous nucleation of the reaction gas occurs and titanium is not likely to be deposited on the surfaces of the particles for deposition. Accordingly, the temperature of at least a part of the particles for deposition is preferably in a range of 715 to 1500° C.

Titanium deposits stably at a lower temperature. Furthermore, the lower temperature operation is desirable in view of a selection of structural material for the reaction vessel. However, reaction products such as $MgCl_2$ may possibly be mixed at a lower temperature. Accordingly, the temperature range is preferably 900 to 1400° C., more preferably 900 to 1300° C., and further preferably 900 to 1200° C. to realize stable industrial production.

In the present invention, titanium metal is deposited on the surfaces of the particles in the titanium metal deposition space. The particles can move in the titanium metal deposition space and may be fluidized by a gas. The particles may be supplied from an upper portion of the titanium metal deposition space to fall toward a lower portion. In this case, the falling particles may be blown upward from a gas blower hole provided in the deposition titanium deposition space to adjusting a residence time of the particles. Since the particles have large surface areas per volume, a contact area with the mixed gas can be ensured. The particles surfaces serve as deposition sites for the introduced mixed gas, and titanium metal can be deposited and grown on the particles.

When the titanium metal particles for deposition are supplied from an upper portion of the deposition space, it is preferable to preheat the particles at a temperature of 300 to 1000° C. before the particles are supplied. The preheating temperature is set not lower than 300° C., since it allows additional heating of the particles in the deposition space at a temperature of 715 to 1500° C. efficiently. The preheating temperature is sufficient up to 1000° C.

The apparatus may comprise a mechanism for separating titanium metal deposited on the particles. For example, vibration may be applied to the particles to remove deposited titanium metal from the particles which may be then collected. The collected particles may be re-supplied as particles.

Size and material for the particles for deposition are not limited. For example, ceramic or metal may be used. A refractory metal is desirable, since it does not melt and change its properties at a temperature of 715 to 1500° C. when the particles are controlled at the temperature range. For effective deposition, the material preferably has a crystalline structure similar to that of titanium. In particular, pure titanium or a titanium alloy is preferable as the material.

Pure titanium is particularly desirable in order to maintain a purity of the collected titanium and prevent mixing of impurities. Then, the particles on which titanium metal is deposited may be used as titanium raw materials as they are.

FIG. 1 shows a schematic sectional side view of an example apparatus for producing titanium metal. The apparatus includes: a magnesium heating section 1 that has a mechanism for evaporating solid magnesium; a first flow channel 5 for supplying gaseous magnesium and in communication with the heating section 1; a second flow channel 7 for supplying gaseous titanium tetrachloride; a gas mixing section 8 in communication with the first flow channel and the second flow channel, in which gaseous magnesium and titanium tetrachloride are mixed; a titanium metal deposition section (deposition space) 9 in communication with the gas mixing section 8; and a mixed gas discharge section 16 in communication with the titanium metal deposition space 9.

The magnesium heating section 1 is composed of a crucible 2 in which magnesium is placed and a thermal source for evaporating magnesium. As an example of the thermal source, FIG. 1 shows a heater 3 around at least a part of a side wall of the crucible 2. The heater raises a temperature in the crucible at a temperature at which magnesium can evaporate. Another example of the thermal source is to use a heater with a coil outside the crucible to heat a graphite wall of the crucible by induction-heating. Induction-heating is efficient for heating, and is advantageous in that magnesium can be evaporated while contamination of magnesium is prevented, since magnesium does not contact the thermal source. Further another example of the thermal source is a DC plasma torch as a mechanism for evaporating magnesium.

The first flow channel 5 for supplying gaseous magnesium in the gas mixing section 8 is connected to the magnesium heating section 1. According to an embodiment of the invention, a heater 6 can be provided around at least a part of a side wall of the first flow channel 5. The heater raises a temperature in the flow channel at a temperature at which magnesium can evaporate so as to prevent magnesium from depositing in the channel. As an alternative embodiment, a heater with a coil is provided outside the flow channel to heat a graphite wall of the channel by induction-heating.

The apparatus according to the invention includes the second flow channel 7 for supplying gaseous titanium tetrachloride in the gas mixing section 8. According to an embodiment of the invention, a heater 10 can be provided around at least a part of a side wall of the second flow channel 7. The heater raises a temperature in the second flow channel at a predetermined temperature. The second flow channel 7 may be made of a material having corrosion resistance against a chloride vapor. For example, the corrosion resistant material may be graphite. As an alternative embodiment, the second flow channel 7 can be heated with a heater with a coil. The second flow channel 7 can be heated by induction-heating a graphite wall of the second flow channel 7.

The first flow channel 5 for supplying gaseous magnesium and the second flow channel 7 for supplying gaseous titanium tetrachloride are connected to the gas mixing section 8. The gas mixing section 8 is controlled at a temperature of not lower than 1600° C. This is because the reaction of reducing titanium tetrachloride with magnesium does not occur as long as the temperature is maintained at the level. At this time, the gas mixing section 8 is preferably controlled to an absolute pressure of 50 to 500 kPa in order to avoid the reduction reaction. A heater 11 can be provided around at least a part of side walls of the gas mixing section to control the gas mixing section at the above temperature. Inner wall of the gas mixing section may desirably be made of a material having corrosion resistance against a chloride vapor, and an example corrosion resistant material may be graphite. According to an embodiment of the invention, the temperature is controlled by a heater with a coil on the outside of a side wall of the gas mixing section to heat the wall by induction-heating.

Figure 2:
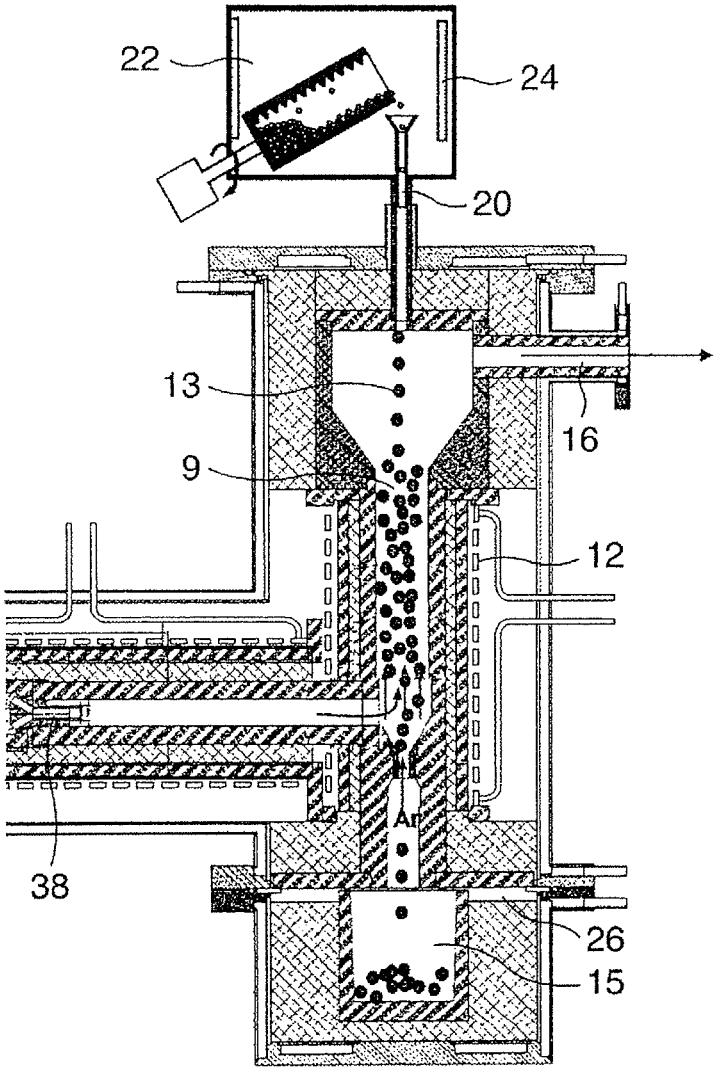
FIG. 2 is a schematic sectional side view of an example deposition section of the apparatus.

The titanium metal deposition space 9 is connected to the gas mixing section 8, and is maintained at an absolute pressure of 50 to 500 kPa. Preferably, the titanium metal deposition space 9 is controlled to an absolute pressure of 90 to 200 kPa. FIG. 2 shows a schematic sectional side view of an example titanium metal deposition space 9. Particles 13 for deposition are supplied from a particles supply section 20 at an upper portion of the titanium metal deposition space 9 and heated at a temperature of 715 to 1500° C. of the deposition space 9. Preferably, the particles 13 are controlled in a temperature range from 900 to 1400° C. The particles fall through the titanium metal deposition space 9 into a collection section 15. A gas is blown through a blower hole 26. The gas is preferably an inert gas such as Ar. Falling time of the particles may be adjusted by the resistance caused by the gas. The particles may be floated.

The mixed gas is introduced into the titanium metal deposition space 9 while it remains unreacted. An orifice 38 may be provided in a passage from the gas mixing section to the titanium metal deposition space 9. The mixed gas from the gas mixing section 8 enters from a side of the titanium metal deposition space 9 and causes the reduction reaction of titanium tetrachloride by magnesium. The surfaces of the falling particles 13 serve as deposition sites, and titanium metal is deposited and grown on the surfaces of the particles.

A preheating section 22 for preheating the particles can be provided above the particles supply section 20 and a heater 24 can be provided around at least a part of a side wall of the preheating section 22 to preheat the particles 13. Preferably, the particles 13 can be heated at a temperature of 300 to 1000° C. In FIG. 2, a container for containing the particles for deposition is provided with helical grooves on an inner surface of the container. When the container is tilted and rotated, the particles fall in the helical grooves and are conveyed upward in the container. The particles reach the rim of container and are sequentially fed in the particles supply section 20.

A heater 12 may be also provided in the titanium metal deposition space 9 to adjust the temperature of the particles. Inner walls of the titanium metal deposition space may be desirably made of a material having corrosion resistance against a chloride vapor, and an example corrosion resistant material may be graphite. As another example, the temperature is controlled by a heater with a coil on the outside of a side wall of the titanium metal deposition space to heat the wall by induction-heating.

The particles collected in the collection section 15 may be supplied again from the supply section 20 after titanium metal has been removed off from the particles. Alternatively, the particles with deposited titanium metal may be supplied again from the supply section 20. In a case where the particles for deposition are made of titanium metal, the particles can be also used as titanium metal in a deposited state.

The mixed gas of gaseous magnesium and gaseous titanium tetrachloride except for titanium deposited and grown in the titanium metal deposition space 9 is discharged from a discharge section 16 connected to the deposition section, and by-products or magnesium chloride is collected by a filter or the like.

According to the process of the invention, titanium can be continuously produced and the produced titanium metal is suitable for a material for melting or a powder metallurgy. The process can be also applied to production of an ingot for electronic materials, aircraft parts, or power and chemical plants.

Embodiments of the process for producing titanium metal according to the invention are explained above. However, the invention is not limited thereto, and can be modified without departing from the spirit and scope of the present invention as defined in the claims.

REFERENCE SIGNS LIST

1 magnesium heating section
2 crucible
3 heater
5 first flow channel
6 heater
7 second flow channel
8 gas mixing section

9 titanium metal deposition space
10, 11, 12 heater
13 particles for deposition
15 collector
16 discharge section
20 supply section
22 preheating section
24 heater
26 blower hole
38 orifice

The invention claimed is:

1. An apparatus for producing titanium metal, comprising:

(a) a first flow channel for supplying gaseous magnesium;

(b) a second flow channel for supplying gaseous titanium tetrachloride;

(c) a gas mixing section in communication with the first flow channel and the second flow channel, wherein the gaseous magnesium is mixed with the gaseous titanium tetrachloride in the gas mixing section, and a temperature within the gas mixing section is controlled at not lower than 1600° C.;

(d) a titanium metal deposition section in communication with the gas mixing section, wherein the titanium metal deposition section is at a temperature of 715 to 1500° C. and under an absolute pressure of 50 to 500 kPa, and wherein particles for deposition are movably disposed in the titanium metal deposition section; and (e) a mixed gas discharge section in communication with the titanium metal deposition section, wherein the particles are supplied from an upper portion of the titanium metal deposition section, and the gas mixing section is communicatively connected to a side of the titanium metal deposition section.

2. The apparatus according to claim 1, wherein the absolute pressure in the titanium metal deposition section is 90 to 200 kPa.

3. The apparatus according to claim 1, wherein at least one of the first flow channel, the second flow channel, the gas mixing section, and the titanium metal deposition section comprises a graphite wall.

4. The apparatus according to claim 3, wherein the apparatus includes an induction coil around at least a part of the graphite wall to heat the graphite wall.

5. The apparatus according to claim 1, wherein the titanium metal deposition section is in a temperature range from 900 to 1400° C.

6. The apparatus according to claim 1, wherein the particles are made of titanium or a titanium alloy.

7. The apparatus according claim 1, wherein the titanium metal deposition section further comprises a gas blower hole for blowing a gas in order to adjust retaining time of the particles in the titanium metal deposition section.

8. The apparatus according to claim 1, further comprising a particles preheating section for heating the particles at a temperature of 300 to 1000° C. before the particles are supplied.

9. A process for producing titanium metal, comprising steps of:

(a) supplying gaseous magnesium and gaseous titanium tetrachloride in a mixing space having a temperature of not lower than 1600° C. to form a mixed gas;

(b) introducing the mixed gas in a titanium metal deposition space, wherein the titanium metal deposition space is in a temperature range from 715 to 1500° C. and under an absolute pressure of 50 to 500 kPa, and wherein particles for deposition are movably disposed in the titanium metal deposition space;

(c) causing titanium metal deposited and grown on the particles; and (d) discharging the mixed gas after the step (c);

wherein the step (b) comprises introducing the mixed gas from a side of the titanium metal deposition space, and supplying the particles from an upper portion of the titanium metal deposition space to allow the particles to fall toward a lower portion of the titanium metal deposition space; and wherein the process for producing titanium metal is carried out using the apparatus of claim 1.

10. The process according to claim 9, wherein the step (b) further comprises blowing a gas toward the particles for adjusting retaining time of the particles.

11. The process according to claim 9, wherein the step (b) further comprises preheating the particles at a temperature of 300 to 1000° C. prior to supplying the particles.

* * * * *